US006665891B1

(12) United States Patent
Clifford

(10) Patent No.: US 6,665,891 B1
(45) Date of Patent: Dec. 23, 2003

(54) PORTABLE HAIR WASHING APPARATUS

(76) Inventor: Ninarose A. Clifford, 2741 E. Desoto St., Unit 7, Long Beach, CA (US) 90814

( * ) Notice: Subject to any disclaimer, the term of this patent is extended or adjusted under 35 U.S.C. 154(b) by 0 days.

(21) Appl. No.: 10/233,385

(22) Filed: Sep. 3, 2002

(51) Int. Cl.[7] ..... A45D 19/04
(52) U.S. Cl. ..... 4/516; 4/518; 4/519
(58) Field of Search ..... 4/516, 518, 519, 4/523, 515

(56) References Cited

U.S. PATENT DOCUMENTS 2,850,742 A * 9/1958 Glintz ..... 4/516
3,013,280 A * 12/1961 Coffman et al. ..... 4/516
3,192,537 A * 7/1965 Coffman et al. ..... 4/516
5,014,371 A * 5/1991 Heel ..... 4/516

* cited by examiner

*Primary Examiner*—Gregory L. Huson
*Assistant Examiner*—Kathleen J. Prunner

(57) ABSTRACT

A portable hair washing apparatus for allowing the shampooing of the hairs of the physically disabled includes a tank member having side, front, back, and bottom walls, and also having a tabletop; and also includes wheels upon which the tank member is mounted; and further includes a hair washing support assembly being attached to the tank member and including a headrest member; and also includes a hair washing assembly being supported by the tank member and including a semi-rigid hose being attached to the tank member.

9 Claims, 4 Drawing Sheets

PORTABLE HAIR WASHING APPARATUS

BACKGROUND OF THE INVENTION

1. Field of the Invention

The present invention relates to portable hair washers and more particularly pertains to a new portable hair washing apparatus for allowing the shampooing of the hairs of the physically disabled.

2. Description of the Prior Art

The use of portable hair washers is known in the prior art. More specifically, portable hair washers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,678,255; U.S. Pat. No. 4,512,043; U.S. Pat. No. 3,192,537; U.S. Pat. No. 3,523,306; U.S. Pat. No. 5,966,751; and U.S. Pat. No. Des. 333,343.

While these devices fulfill their respective, particular objectives and requirements, the aforementioned patents do not disclose a new portable hair washing apparatus. The prior art includes basins and tank units for cleaning people's hair.

SUMMARY OF THE INVENTION

The general purpose of the present invention, which will be described subsequently in greater detail, is to provide a new portable hair washing apparatus which has many of the advantages of the portable hair washers mentioned heretofore and many novel features that result in a new portable hair washing apparatus which is not anticipated, rendered obvious, suggested, or even implied by any of the prior art portable hair washers, either alone or in any combination thereof. The present invention includes a tank member having side, front, back, and bottom walls, and also having a tabletop; and also includes wheels upon which the tank member is mounted; and further includes a hair washing support assembly being attached to the tank member and including a headrest member; and also includes a hair washing assembly being supported by said tank member and including a semi-rigid hose. None of the prior art includes the combination of the elements of the present invention.

There has thus been outlined, rather broadly, the more important features of the portable hair washing apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new portable hair washing apparatus which has many of the advantages of the portable hair washers mentioned heretofore and many novel features that result in a new portable hair washing apparatus which is not anticipated, rendered obvious, suggested, or even implied by any of the prior art portable hair washers, either alone or in any combination thereof.

Still another object of the present invention is to provide a new portable hair washing apparatus for allowing the shampooing of the hairs of the physically disabled.

Still yet another object of the present invention is to provide a new portable hair washing apparatus that is easy and convenient to set up and use.

Even still another object of the present invention is to provide a new portable hair washing apparatus that is fully self-contained and can be maneuvered about to where the user is located.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
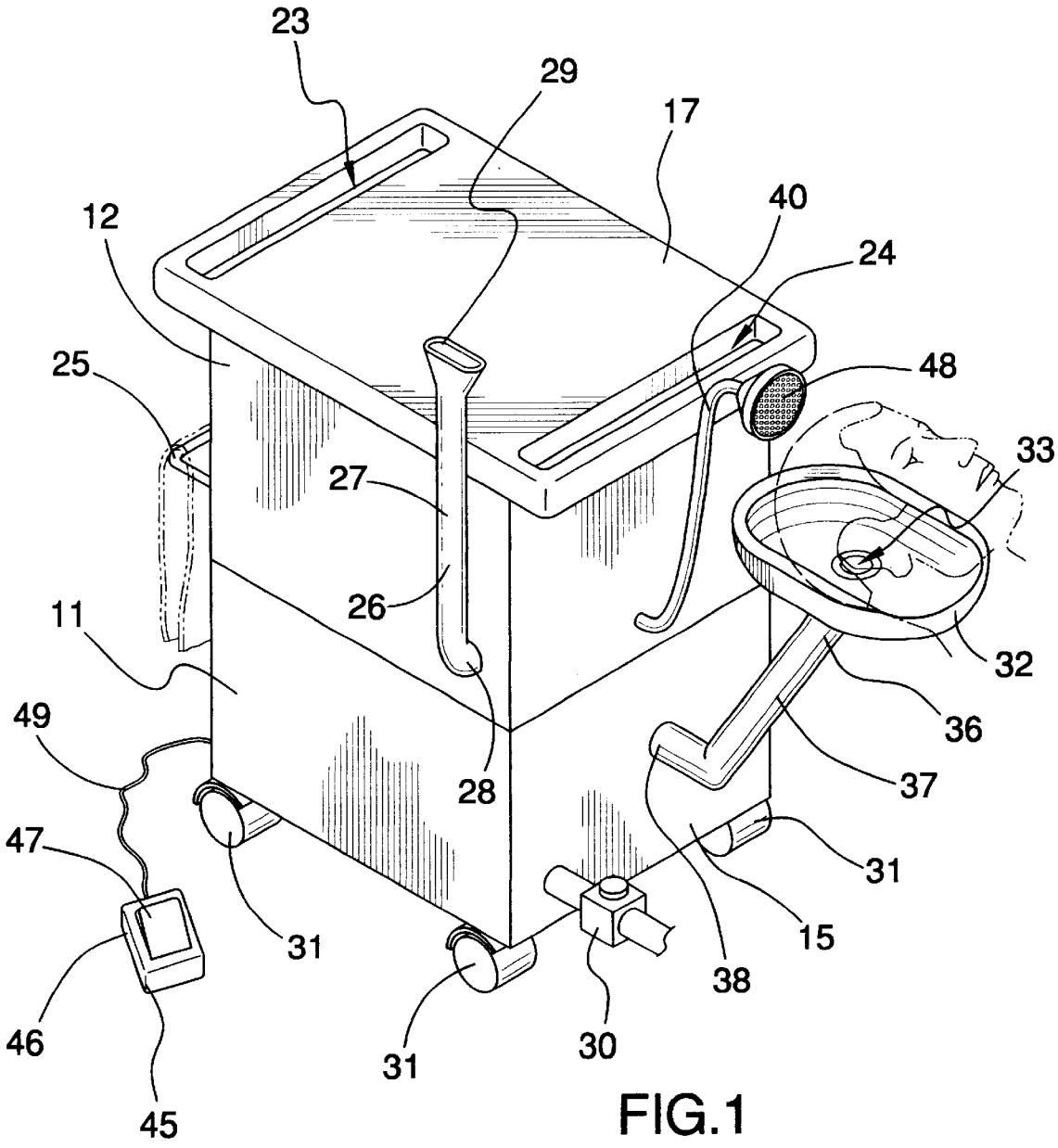
FIG. 1 is a perspective view of a new portable hair washing apparatus according to the present invention.
Figure 2:
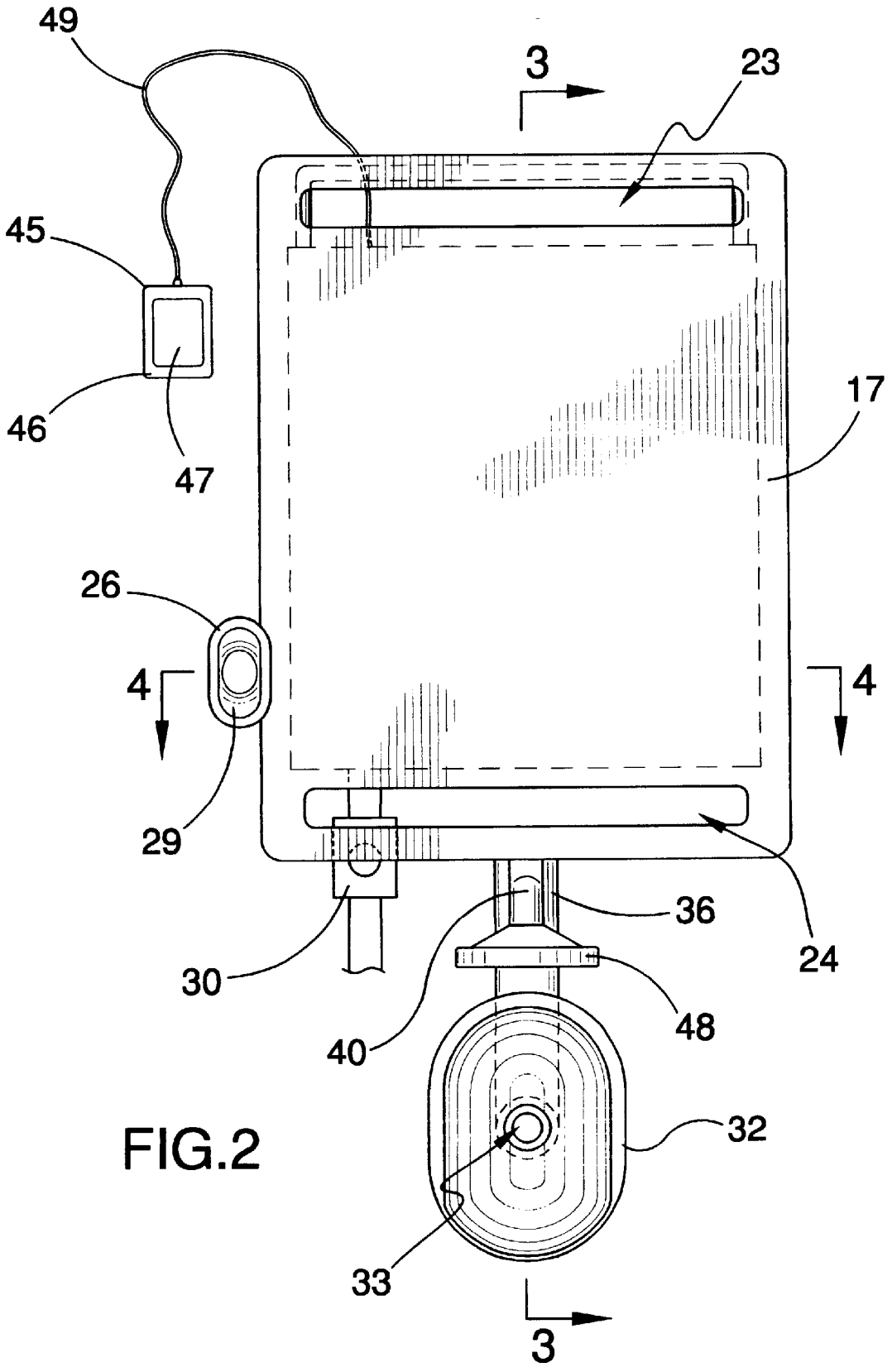
FIG. 2 is a top plan view of the present invention.
Figure 3:
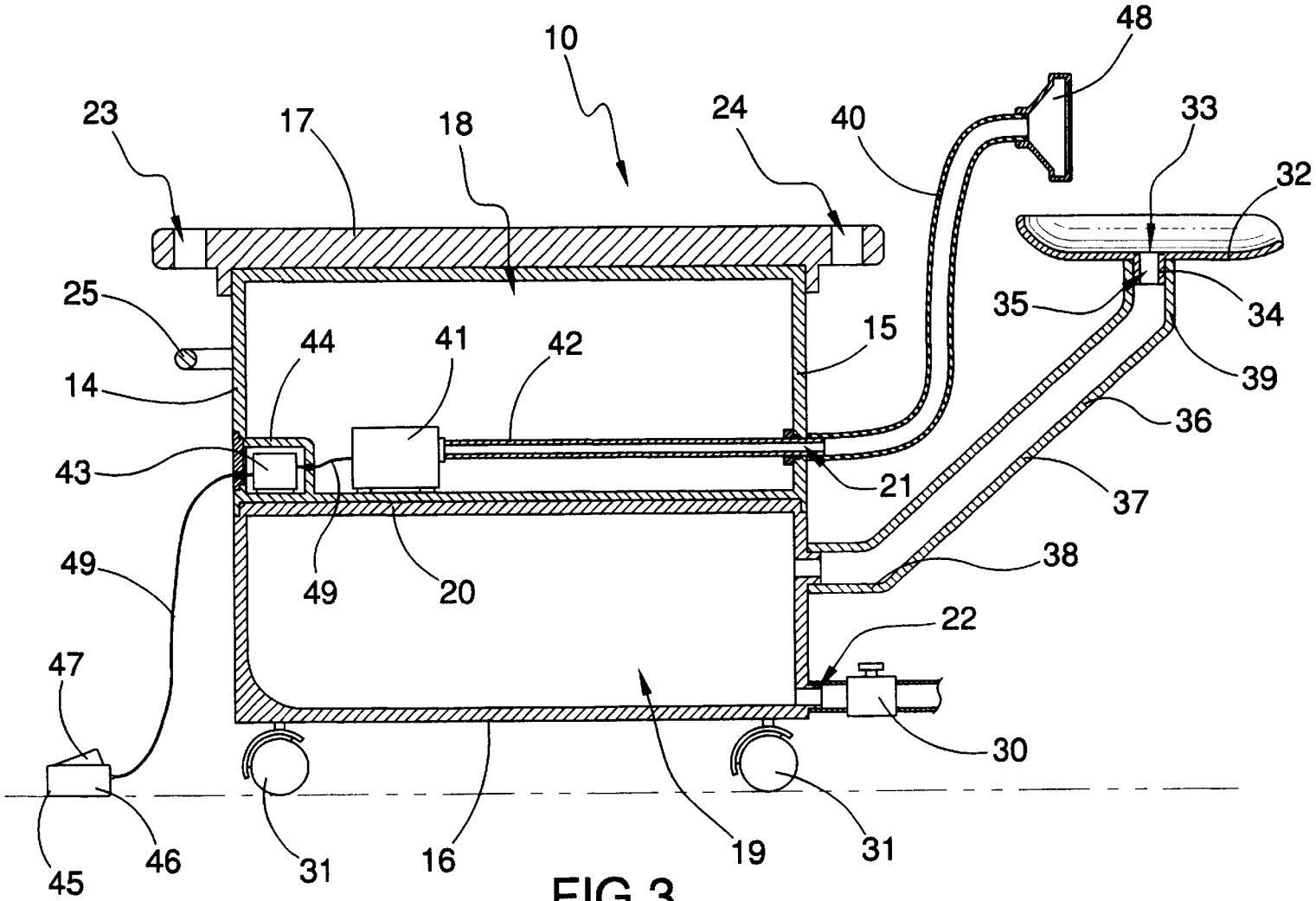
FIG. 3 is a longitudinal cross-sectional view of the present invention.
Figure 4:
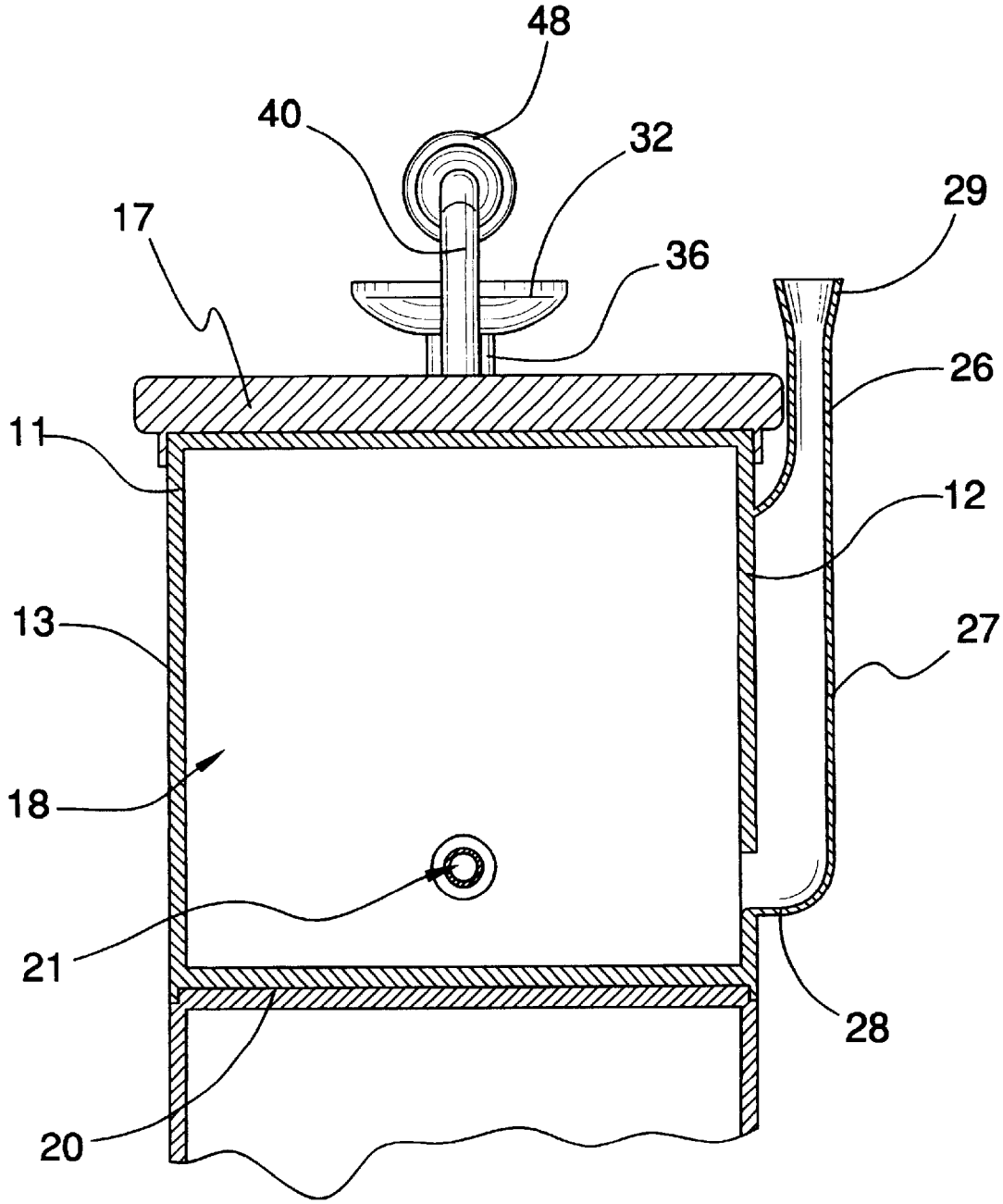
FIG. 4 is a lateral cross-sectional view of the present invention.

With reference now to the drawings, and in particular to FIGS. 1 through 4 thereof, a new portable hair washing apparatus embodying the principles and concepts of the present invention and generally designated by the reference numeral 10 will be described.

As best illustrated in FIGS. 1 through 4, the portable hair washing apparatus 10 generally comprises a tank member II having side, front, back, and bottom walls 12–16, and also having a tabletop 17. The tank member 11 also includes an upper compartmental and a lower compartment 19 being separated by one or more impermeable walls 20 being conventionally disposed between the tabletop 17 and the bottom wall 16. The upper and lower compartments 18, 19 are adapted to store water therein. The tank member 11 further includes a water outlet port 21 being disposed through the front wall 15 and into the upper compartment 18, and also includes a water drainage port 22 being disposed through the front wall 15 into the lower compartment 19 for draining water therefrom, and further includes a valve 30 being conventionally connected to the water drainage port 22 for controlling drainage of water from the lower compartment 19. The tank member 11 also includes a towel rack 25 being conventionally attached to an exterior of the back wall 14 for supporting towels. The tank member 11 further includes an elongate tubular water fill hopper 26 being conventionally mounted to the tank member 11 and through which water is entered into the upper compartment 18 of the tank member 11. The elongate tubular water fill hopper 26 includes a main portion 27 which extends parallel and adjacent to one of the side walls 12 of the tank member 11, and also includes a bottom end portion 28 which is conventionally disposed through the side wall 12 and into the upper compartment 18, and further includes a flared open top end 29 through which water is entered into the tank member 11. The tabletop 17 includes elongate handhold slots 23, 24 being disposed therethrough near ends thereof with the tabletop 17 extending outwardly beyond the front and back walls 14,15. The tank member 11 is conventionally mounted upon wheels 31.

A hair washing support assembly is conventionally attached to the tank member 11 and includes a headrest member 32. The hair washing support assembly further includes a drainage pipe 36 being conventionally mounted to the tank member 11, and having a main portion 37, and also having a first end portion 38 being angled relative to the main portion 37 and being conventionally disposed through the front wall 15 into the lower compartment 19 of the tank member 11, and further having a second end portion 39 being angled relative to the main portion 37 and upon which the headrest member 32 is mounted. The headrest member 32 is generally a basin having a drainage hole 33 being disposed through a wall thereof with the headrest member 32 having a boss 34 which is securely mounted in an open second end of The drainage pipe 36 and which has a bore 35 disposed therethrough.

A hair washing assembly is conventionally supported by the tank member 11 and includes a semi-rigid hose 40 being conventionally attached over the water outlet port 21 of the tank member 11. The hair washing assembly further includes a water pump member 41 being conventionally disposed in the upper compartment 18 of the tank member 11, and also includes a conduit 42 being conventionally attached to the water pump member 41 and to the water outlet port 21 of the tank member 11, and further includes a battery 43 being disposed in a battery compartment 44 in the tank member 11 and being connected with wires 49 to the water pump member 41, and also includes a pump activation switch 45 being connected with wires 49 to the battery 43, and further includes a spray nozzle 48 being conventionally attached to a free end of the semi-rigid hose 40 for spraying water onto a user's hair. The pump activation switch 45 includes a housing 46 and a foot pedal 47 being depressibly and conventionally mounted upon the housing 46.

In use, the user pushes or pulls the tank member 11 to the desired location where a particular person wants or needs to have one's hair shampooed, and the user situates the person's head upon the headrest member 32, and grasps and positions the semi-rigid hose 40 over the person's hair, and then presses upon the foot pedal 47 which energizes the water pump member 41 which pumps water contained in the upper compartment 18 of the tank member through the conduit 42 and through the semi-rigid hose 40 and through the spray nozzle 48 onto the person's hair. The waste water drains from the headrest member 32 through the drainage pipe 36 and is stored in the lower compartment 19 of the tank member 11. The waste water is emptied through the water drainage port 22 using the valve 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the portable hair washing apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable hair washing apparatus comprising:

a tank member having side, front, back, and bottom walls, and also having a tabletop, said tank member also including an upper compartment and a lower compartment being separated by one or more impermeable walls being disposed between said tabletop and said bottom wall, said upper and lower compartments being adapted to store water therein, said tank member further including a water outlet port being disposed through said front wall and into said upper compartment, and also including a water drainage port being disposed through said front wall into said lower compartment for draining water therefrom, and further including a valve being connected to said water drainage port for controlling drainage of water from said lower compartments;

wheels upon which said tank member is mounted;

a hair washing support assembly being attached to said tank member and including a headrest member; and a hair washing assembly being supported by said tank member and including a semi-rigid hose being attached to said tank member.

2. A portable hair washing apparatus as described in claim 1, wherein said tank member also includes a towel rack being attached to an exterior of said back wall for supporting towels.

3. A portable hair washing apparatus as described in claim 2, wherein said tank member further includes an elongate tubular water fill hopper being mounted to said tank member and through which water is entered into said upper compartment of said tank member.

4. A portable hair washing apparatus as described in claim 3, wherein said elongate tubular water fill hopper includes a main portion which extends parallel and adjacent to one of said side walls of said tank member, and also includes a bottom end portion which is disposed through said side wall and into said upper compartment, and further includes a flared open top end through which water is entered into said tank member.

5. A portable hair washing apparatus as described in claim 3, wherein said tabletop includes handhold slots being disposed therethrough near ends thereof, said tabletop extending outwardly beyond said front and back walls.

6. A portable hair washing apparatus as described in claim 5, wherein said hair washing support assembly further includes a drainage pipe being mounted to said tank member, and having a main portion, and also having a first end portion being angled relative to said main portion and being disposed through said front wall into said lower compartment of said tank member, and further having a second end portion being angled relative to said main portion and upon which said headrest member is mounted.

7. A portable hair washing apparatus as described in claim 6, wherein said headrest member is generally a basin having a drainage hole disposed through a wall thereof, said headrest member having a boss which is securely mounted in an open second end of said drainage pipe and which has a bore disposed therethrough.

8. A portable hair washing apparatus as described in claim 7, wherein said hair washing assembly further includes a water pump member being disposed in said upper compartment of said tank member, and also includes a conduit being attached to said water pump member and to said water outlet port of said tank member, and further includes a battery being disposed in a battery compartment in said tank member and being connected with wires to said water pump member, and also includes a pump activation switch being connected with wires to said battery, and further includes a spray nozzle being attached to a free end of said semi-rigid hose for spraying water onto a user's hair.

9. A portable hair washing apparatus as described in claim 8, wherein said pump activation switch includes a housing and a foot pedal being depressibly mounted upon said housing.

* * * * *